US005090228A

United States Patent [19]

Schmiedberg et al.

[11] Patent Number: 5,090,228

[45] Date of Patent: Feb. 25, 1992

[54] WINDOW AND ROLL CHOCK ARRANGEMENT FOR A ROLLING MILL

[75] Inventors: Winfried Schmiedberg, Pittsburgh, Pa.; Dieter Daub, Hilchenbach, Fed. Rep. of Germany

[73] Assignee: SMS Engineering, Inc., Pittsburgh, Pa.

[21] Appl. No.: 455,494

[22] Filed: Dec. 22, 1989

[51] Int. Cl.[5] ..... B21B 31/08; B21B 31/18; B21B 31/32

[52] U.S. Cl. ..... 72/238; 72/245; 72/247

[58] Field of Search ..... 72/237, 238, 239, 245, 72/247

[56] References Cited

U.S. PATENT DOCUMENTS

| | | | |
|---|---|---|---|
| 3,736,785 | 6/1973 | Marten | 72/238 |
| 3,864,954 | 2/1975 | Eibe et al. | 72/238 |
| 4,162,626 | 7/1979 | Decima et al. | 72/238 |
| 4,543,810 | 10/1985 | Stoy et al. | 72/245 |
| 4,744,235 | 5/1988 | Schiller | 72/238 |
| 4,907,439 | 3/1990 | Diel et al. | 72/238 |

FOREIGN PATENT DOCUMENTS

| | | | |
|---|---|---|---|
| 0256410 | 2/1988 | European Pat. Off. | 72/247 |
| 2250953 | 9/1977 | Fed. Rep. of Germany . | |
| 3331055 | 3/1985 | Fed. Rep. of Germany | 72/247 |
| 0087910 | 5/1984 | Japan | 72/238 |
| 0138010 | 5/1989 | Japan | 72/247 |

*Primary Examiner*—Lowell A. Larson
*Assistant Examiner*—Thomas C. Schoeffler
*Attorney, Agent, or Firm*—Clifford A. Poff

[57] ABSTRACT

The disclosure relates to a window layout and a work roll chock design of a four-high rolling mill stand, including two spaced upright housing posts having windows, in which the housing ports have roll bending devices for the work rolls and the chocks of the work rolls are mounted so as to be horizontally and vertically disposed relative to inner window chock support members, which in turn are connected to outer window blocks affixed to the housings. To effect a roll change of both work rolls as a unit with a roll change device arranged in front of the operator side window, the work roll chocks are provided with roll separator units for holding the rolls apart and stabilizing the unit and a locking device for preventing relative horizontal movement of the work rolls during a roll change.

17 Claims, 3 Drawing Sheets

WINDOW AND ROLL CHOCK ARRANGEMENT FOR A ROLLING MILL

BRIEF SUMMARY OF THE INVENTION

The invention relates to an improved rolling mill stand window design and a roll chock design therefor for aiding in the quick and efficient roll changing of the stand, and more particularly, to an arrangement in which the work rolls of a four-high rolling mill stand are equipped with work roll bending devices, and where in one condition the chocks of the work rolls slide horizontally within inner members relative to each other and in another they are locked against horizontal movement, and the inner members are connected to outer vertical blocks affixed to the housings of the stand in such a way that the inner members can slide vertically.

BACKGROUND OF THE INVENTION

A four-high roll stand consisting of two upright housings with work and back-up rolls and with roll bending devices for the work rolls are known to the art from West German DE patent publication 22 50 953. In such roll stands the chocks of the work rolls are located between vertical blocks anchored in the windows of each housing. The work rolls are deflected at their ends for roll crow control by double acting piston cylinder roll bending units carried by intermediate members which are contacted by the chocks. Each vertical block affixed to an associated housing is designed to support the intermediate members which can slide vertically in the window of the stand. Each intermediate member is provided with two sets of horizontal rails which extend parallel to the rolls adjacent the axes of the work rolls through and between the operating and drive side housings for the purpose of supporting the chocks during roll changing. This means that as many as four such rails may be employed. The vertical blocks affixed to the housings have vertical guides that project towards the inner members which are equipped with corresponding grooves. With the aid of this roll stand construction the work rolls can be adjusted both vertically and displaced horizontally over a wide range.

This construction makes it possible to more quickly change the work rolls as a unit than previous systems without the need to disconnect the hydraulic system for the roll bending piston cylinder assemblies. Part of this was accomplished by later designs in which the vertical blocks affixed to the housing were equipped with piston cylinder units which positioned and supported the work roll chocks and moved the chocks in such a way that the elevation of the rails carried thereby were brought in line with the receiving surface or tracks of a roll change rig arranged on the operator side in front of the window of the mill stand. Some of the above referenced characteristics are disclosed in U.S. Pat. Nos. 3,736,785 and 4,543,870.

This construction and referenced elements found necessary to change the work rolls set in the above described mill arrangement possessed some serious disadvantages, particularly in the employment and location of the chock supporting rails and in mills employing means for moving the work rolls axially relative to each other, which will be more fully discussed below.

With reference to these shortcomings, it is the object of the present invention to greatly simplify the construction and number of elements necessary to change the work roll set in a rolling mill stand and wherein the employment of chock supporting members or rails in the location of the work rolls are not required. While the invention is particularly useful in mills for rolling strip wherein the work rolls are adjusted in opposite axial directions, it may find use in mills not having this feature.

It is another object of the present invention to provide an improved mill arrangement for effecting a roll change, by eliminating, to a large extent, the multiple arrangement of complicated roller or glide paths employed in the past in the area of the windows and by changing the upper and the lower work rolls a unit by employing only one set of rails arranged away from the roll bite. In a mill where the work rolls are axially moved relative to each other, this, in part, is accomplished according to the invention by providing a locking mechanism to firmly interlock the work rolls and their chocks to perform a roll changing, which during operation of the mill can be disengaged to permit relative axial roll movement.

The above objects are achieved by providing a work roll separator, preferably filled with an elastomer, in the lower work roll chocks, the free end of which supports the upper work roll chocks in such a way that they may be moved horizontally. Since the upper work roll chocks may be secured against sliding horizontally in relation to the lower work roll chocks, the work roll change can be executed in a new way, i.e. the two work rolls, arranged one above the other and interlocked in a stable manner, can be jointly pulled from the stand onto a roll change platform. The chock supporting rails which up to now had been required for the upper work roll can be eliminated.

Furthermore, the enlargement of the clearance in the area of the roll bite improves the procedure of threading the rolled strip through the mill, allows the system of guiding the strip into the entry area of the work rolls to be improved and enlarges the space for removing torn strips during a strip "wreck". The enlargement of the clearance of the roll stand in the roll bite area also simplifies the mounting of the spray headers, as well as that of the readjustment of the spray angle.

With the aid of the elastic work roll separators located in the lower work roll chocks, a secure stable support of the upper work roll on the lower work roll and the maintenance of the distance between them is assured and there is not required special monitoring. The roll separators filled with an elastomer, therefore, must only be constructed in such a way that it is sufficiently strong to bear the weight of the upper work roll and its chocks, without impairing compliance with conventional safety requirements. Due to the fact that the elastic separators in the lower work roll chocks function in conjunction with the locking device in one of the upper work roll chock, the two work rolls can be secured together as a unit as a compact structure for the roll change.

With reference to the locking device of the present invention, it is proposed to attach centering pieces to the upper free ends of the roll separator pistons, and as to one of the pistons of the drive side upper chock a bolt of the locking device can be pushed from above. The centering pieces of the separator pistons are received in longitudinal grooves cut into glide plates of the upper work roll chocks, which grooves are approximately the same length as the distance of the counter-directional horizontal movement of the work rolls. The centering pieces may be designed and made from a material allowing the upper work roll chocks to slide smoothly, although the pistons of the separators are constantly exerting a force on the upper work roll chocks. The centering pieces of the separator pistons provide additional assurance against unintentional movement of the work rolls toward each other during the roll change.

In still referring to the locking device, the bolt of the locking device associated with the one roll separator piston is installed in a vertical hole in the one upper work roll chock and can be adjusted to either a locking position or unlocking position, by means of a stationary actuator attached on the chock outside of the mill housing. The bolt of the locking device is constructed in such a way that it can latch through the glide plate into a recess in the centering piece of the work roll separator. If therefore, for example, the locking bolt is loosely installed in the vertical hole of the upper work roll chock, it can, based on its gravity, lock with the separator, thus interlocking the two work rolls. In order to change rolls, the work rolls need only to slide against one another to find the locking position.

As an additional feature of the disclosed roll locking device, the actuator is provided with a cylinder pin installed in the horizontal hole in the upper drive side work roll chock, with one end of the pin engaging the bolt by a special shaped portion, while its other end functions in conjunction with a latch device which provides at least two positions. The latch device consisting of a spring/ball arrangement functions in conjunction with two ring-shaped spaced apart grooves formed in the cylinder pin. This allows in a simple way for the installation of the locking bolt between two positions, which can be adjusted manually or by means of a hydraulic piston cylinder actuator for greater accuracy, the actuator being attached on the outside of the chock.

The positioning system for the locking bolt of the locking device can, if desired, be made part of the cylinder pin of the actuator by means of an opening in the locking bolt into which engages an offset tongue formed in the cylinder pin. The tongue of the cylinder pin may be surrounded by the inner walls of the opening in the locking bolt on all sides and the height of the offset of the connecting tongue is designed to correspond to the locking position or the unlocking position. In this way the locking bolt is guided by force and its position established with a minimum of mechanical clearance.

Another feature of the roll change system of the present invention is to provide the lower work roll chock in the lower area with glide bars or rollers, which in the locked position of the work rolls are brought into contact with glide rails. The glide rails are preferably attached to a vertical movable support carriage which can be moved against the lower work roll chocks by hydraulic piston cylinder units located in the vertical blocks affixed to the mill housing. In this way, the opening of the windows of the mill housings to effect roll changing is enlarged, as well as providing clearance in the roll bite area of the stand, so that more free space is available for removing and replacing of the work rolls, the spray headers, the guidance systems for the rolled product, etc.

BRIEF DESCRIPTION OF THE DRAWING

The various features and advantages of the present invention will be better appreciated when the following description of the preferred embodiment thereof is read along with the accompanying figures of which.

DETAILED DESCRIPTION OF THE INVENTION

Figure 1:
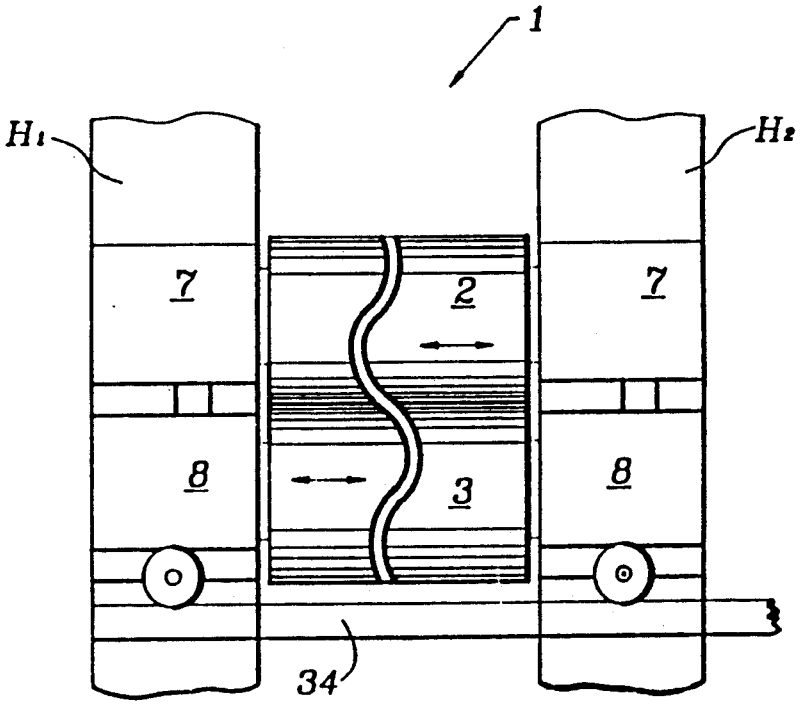
FIG. 1 is a schematic partial side view of a four-high rolling mill stand illustrating the housing post and work rolls thereof.
Figure 2:
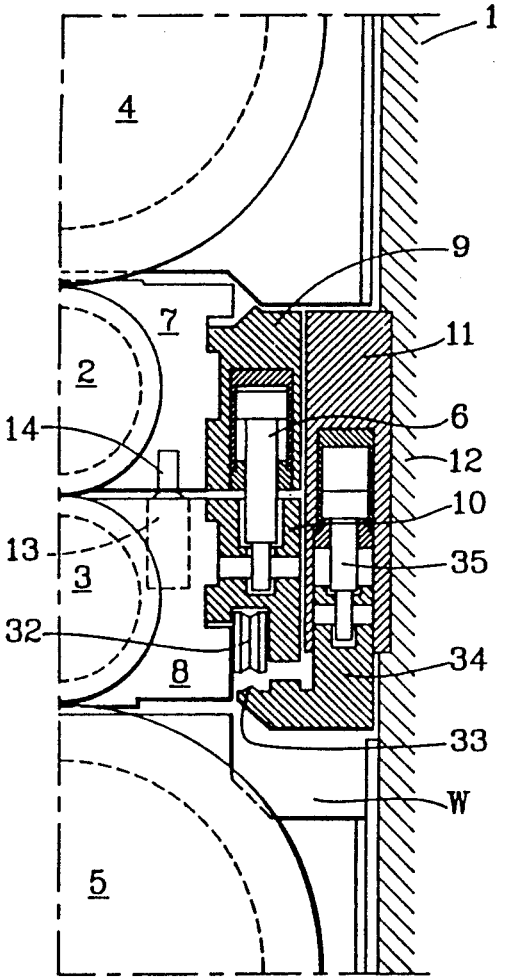
FIG. 2 is a partial sectional view, viewed from the window of the four-high roll stand shown in FIG. 1, illustrating the rollers attached to one of the chock and various other elements in the mill operating condition.
Figure 3:
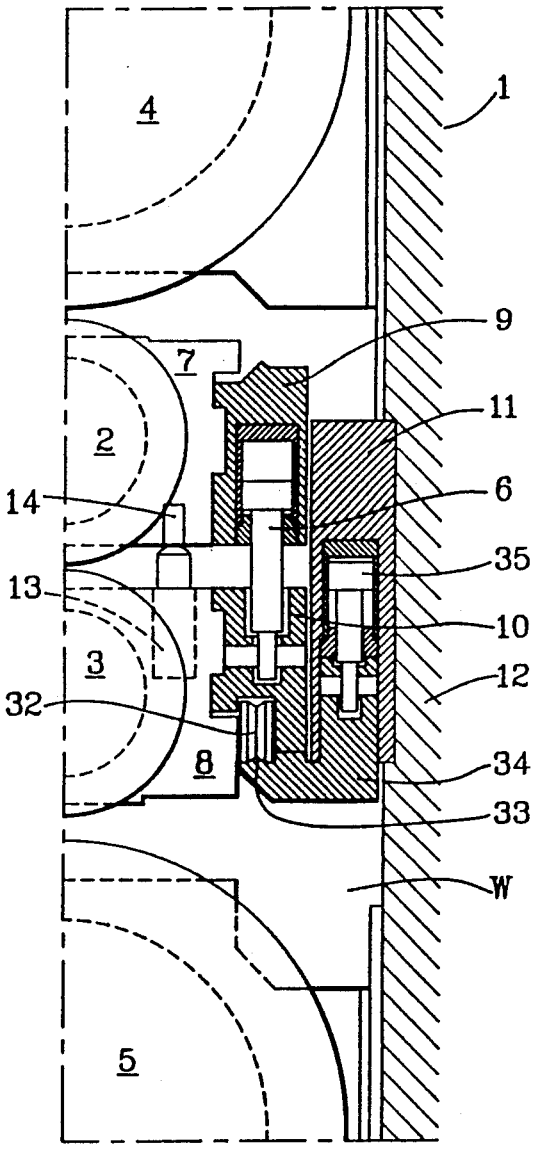
FIG. 3 is a second view of the window of the four-high roll stand according to FIG. 2, but showing the illustrated elements in their roll changing positions.

In first referring to FIG. 1, there is shown a four-high rolling mill stand 1 for rolling metal strip comprising two spaced apart housing posts H 1 and H 2, H 1 being the operator side post and H 2 the drive side post. With reference also to FIGS. 2 and 3 there is shown two conditions of the identical right side of the drive side post of the mill stand 1. The stand having work rolls 2, 3 and back-up rolls 4, 5, shown received in a window W of post H 2. A roll bending device 6 exerts a bending force on the work roll chocks 7, 8. The roll bending device is located within inner members 9, 10, which constrain the vertical sides of the chocks 7, 8 of the work rolls in such a way that they can slide horizontally. The inner members 9, 10 can also be moved vertically during roll bending and for this purpose are connected to a vertical block 11 which is affixed to the mill housing post H 2. The lower work roll chock 8 contains a work roll separator 13 which is preferably filled with elastomer and the upper free end of which supports the upper work roll chock 7 in such a way that it can slide horizontally. The elastomer roll separator 13 is well known and of the type used in the past to support and/or balance work rolls, functions mainly during roll changing in conjunction with a locking device 14 which is installed in the upper work roll chock 7. One type of the elastomer separators are known as "Jarret Springs" in which the springs are formed of silicon and supplied by Rotator Products Limited of Toronto, Ontario. It will be appreciated the mill stand itself along with the other referred to elements are generally well known and need not be described in detail. Also, the left side of the window W and the window of the housing post H 1 are to be understood to be identical to the described right side and the window W, respectively.

Figure 4:
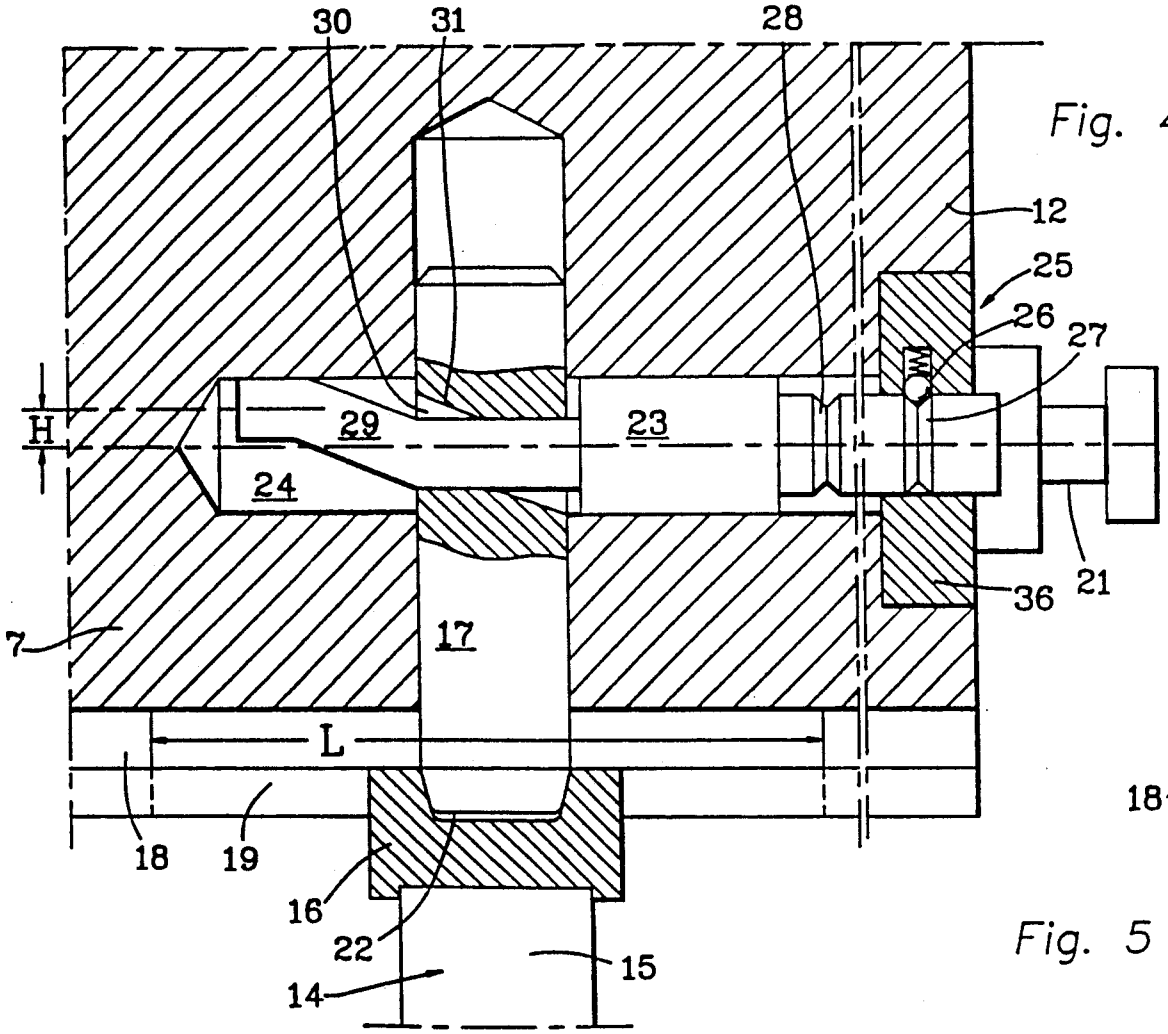
FIG. 4 is a cross section of the locking device for the work rolls in the locking position for effecting a work roll change.
Figure 5:
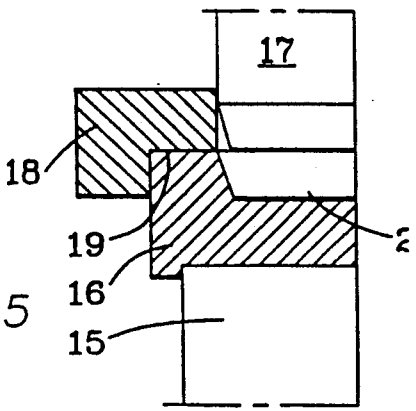
FIG. 5 is a side view of the locking device shown in FIG. 4 in the unlocking position.

FIGS. 4 and 5 show an enlarged view of the details of the locking device 14 viewed along the axial length of the upper chock at the drive side of the post H 2. It is to be understood that each cooperative pair of chocks have two spaced apart roll separators. According to the drawing, each roll separator 13 has a piston 15, in which the upper free end of the piston 15 carries a centering piece 16. In the roll separator that is to be locked a rod or bolt 17 of the locking device 14 can be pushed from above. Because of the arrangement of the centering piece 16 between piston 15 and the locking rod 17, the roll chocks are not weakened by the addition of further holes, also all of the centering pieces may be made of material with good sliding properties which in case of damage are quickly replaceable. In addition all of the centering pieces 16 are installed in glide plates 18 provided in the upper work roll chocks in longitudinal grooves 19 cut into the glide plates 18 which have approximately the same length as the horizontal opposite-directional relative movement distance of the work rolls 2, 3, marked L.

The locking rod 17 of the locking device 14 is installed in a vertical hole in the upper work roll chock 7 and can be adjusted to either an unlocked position according to FIGS. 2 and 5 or to a locked position according to FIGS. 3 and 4, respectively, by means of an actuator 21 which is attached to the chock outside of the mill post H 2. The locking position for the two work rolls 2, 3 according to FIG. 3, which also shows that the bolt 17 of the locking device 14 latches through the glide plate 18 of the upper roll chock 7 in the central area of the longitudinal groove 19 in a recess 22 of the centering piece 16 of the work roll separator 14. The actuator 21 for the locking bolt 17 consists of a cylinder pin 23, which is installed in a horizontal hole 24 in the upper work roll chock 7 and whose end facing the actuator functions in conjunction with a latch device 25 providing at least two positions. For this purpose, the latch device is equipped with a spring/ball arrangement 26 in the horizontal hole 24 or in an adapter piece 36, which latches into two ring-shaped grooves 27, 28 which are separated by a set distance on the cylinder pin 23.

In order to facilitate the forced guidance of the locking bolt 17, the cylinder pin 23 is equipped with a bulged or offset guidance member or connecting tongue 29, which engages in an opening 30 formed in the locking bolt 17. The connecting tongue 29 of the cylinder pin 23 is enclosed on all sides by the inner walls of the opening 30 of the locking bolt 17. Furthermore, the opening 30 is provided with a slanted surface 31, which is designed in relation to the total distance of movement of the connecting tongue 29. The connecting tongue 29 is offset by a distance marked H in FIG. 4. Thus, by being able to move the locking bolt 17 the distance of H, the bolt 17 can be moved to the locking position shown in FIG. 4 or the unlocking position shown in FIG. 5. FIG. 4, therefore, shows the locking position between the upper work roll chock and the lower work roll chock, which is the position assumed in order to execute a roll change where both rolls are removed and replaced as units. FIG. 5, on the other hand, shows the unlocking position for the upper work roll chock 7 from the lower work roll chock in which the two work rolls can be displaced relative to one another horizontally.

As shown in FIGS. 2 and 3, the lower work roll chock 8 at both vertical sides of its lower area are equipped to carry freely rotatable rollers 32, only one of which is shown in FIGS. 2 and 3. These rollers in the locking position of the upper work roll chock 7 with the lower work roll chock 8 (FIG. 4) are brought into contact with support rails 33, affixed to the housing posts, in such a way that the rails 33, extend through both windows and between the housing posts and are located flush with running rails mounted on a well known roll change platform, not shown, arranged adjacent the outside of the window of the operator side housing post H 1.

For this purpose, the rails 33 are mounted on an upward and downward movable support carriage 34, which can be moved vertically against the lower work roll chock 8 by a hydraulically actuated piston cylinder unit 35, within the vertical block 11 which is carried by the mill post H 2. As shown in FIGS. 2 and 3, the rollers 32 project into openings formed in the inner members 9 where the rollers are arranged above the rails 33. FIG. 2 shows, therefore, the roll change position with the upper work roll 2 and its roll chock 7 firmly locked and separated from and carried in a stable manner by the lower work roll chock 8 through the roll separator 14. When considered with the fact that the components of housing post H 1 are identical to H 2, except for the locking device which is not provided in housing post H 1, the work rolls can be displaced with the aid of the rollers 32 and the rails 33 from the windows of the housing posts and can be pulled onto the flush rails of a roll change platform.

From the above it becomes evident that the windows and chock design of the invention provides the features of an enlarged assembly space in the windows of the mill housings and better clearance in the stand in the roll bite area, which offers the above noted advantages in the operation of the rolling mill.

It will be appreciated that while the invention has been explained as employing a locking device in a mill where the work rolls are moved relative to each other for effecting strip crown control and/or control of roll wear, in mills not having this feature the other aspects of the invention can be freely utilized and the associated advantages realized such as the simplicity of window design and the improved system for removal and replacement of the work rolls as a unit.

In accordance with the patent statutes, we have explained our invention in terms of its preferred embodiment, however, it will be readily understood by those skilled in the art to which the invention pertains that it may be practiced otherwise than illustrated and described.

We claim:

1. In a rolling mill stand comprising upright housing means, a vertical window in said housing means, a pair of upper and lower work rolls received in said window having their axes of rotation in a substantial common vertical plane and arranged to form a roll pass, each said roll having bearing chock means for rotatably supporting the opposite ends of said rolls in said window, in which similar ends of said rolls form cooperative pairs, each pair comprising an upper and lower chock means, said chock means having opposite vertical sides, said chock means for said lower roll having a side remote from said pass line, said housing means having stationary block members for said opposite vertical sides of each chock means extending into said window at a location to lend support to said opposite sides of said chock means, intermediate means for each chock means arranged between and in contact with each said block member and an associated said vertical side of said chock means, in a manner to permit said chock means to move axially of the axis of an associated roll relative to said intermediate means and to permit said intermediate means to move vertically with respect to said window relative to an associated block member, means arranged in said window contact with and extendable between each said cooperative pair of chock means for vertically separating said rolls with respect to said window and supporting said rolls in a separated condition, each of said opposite side of said lower chock means having carrying means, each said block member comprising a pair of rail means arranged adjacent said opposite sides of said lower chock means, for selectively engaging said carrying means thereby allowing in said separated condition said rolls as a unit with their chock means to be removed and replaced to and from said window, means carried by each said block member connected to said rail means for moving said rail means into and out of operative and inoperative positions, and said pair of rail means arranged in a generally coplaner relationship with said side of said chock means of said lower roll remote from said roll pass when in said operative and inoperative positions.

2. In a rolling mill stand according to claim 1, wherein said means carried by each said block member comprises a piston cylinder assembly means for each said block member.

3. In a rolling mill stand according to claim 1, wherein said housing means comprises two spaced apart upright posts, each having a said window, each said window having a said pair of cooperative pairs of chocks, said block members and said intermediate means, and wherein said rail means is arranged to extend between said posts and through said windows for engaging said carrying means of said lower chock means.

4. In a rolling mill stand according to claim 3, wherein said carrying means includes wheel means secured to a lower portion of said opposite sides of said lower chock means, said wheel means and said rail means being arranged in a juxtapose relationship when said wheel means is engaged by said rail means, and means for causing said rail means to engage said wheel means.

5. In a rolling mill stand according to claim 1, including work roll bending means carried by said intermediate means connectable to each said chock means for applying forces to said chock means to tend to bend the rolls about their ends, and wherein said separating means comprises a self contained elastomer piston cylinder assembly means for each pair of cooperative chock means.

6. In a rolling mill stand according to claim 5, wherein said axial movement of said chock means includes moving one roll relative to the other roll, locking means carried by one of said chock means for selectively preventing said pair of rolls from moving axially relative to each other during said removal and replacement, and said locking means including means for selectively engaging said elastomer piston cylinder assembly means in a manner to prevent relative movement between cooperative pairs of chock means.

7. In a rolling mill stand according to claim 6, wherein said one carrying chock means for said locking means is the said upper chock means of said one cooperative pair of chock means.

8. In a rolling mill stand comprising upright housing means, said housing means comprises two spaced apart posts, a vertical window in each said post, a pair of work rolls received in said windows having their axes of rotation in a substantial common vertical plane and arranged to form a roll pass, each said roll having bearing chock means for rotatably supporting the opposite ends of said rolls in an associated said window, in which similar ends of said rolls form cooperative pairs of upper and lower chock means, said chock means having opposite vertical sides, said housing means having for said opposite vertical sides of each chock means stationary block members extending into as associated said window at a location to lend support to said opposite sides of said chock means, intermediate means for each chock means arranged between and in contact with each said block member and an associated said vertical side of said chock means, in a manner to permit said chock means to move axially relative to said intermediate means and to permit said intermediate means to move vertically relative to an associated block member, means arranged in said windows in contact with and extendable between each said cooperative pairs of chock means for vertically separating said rolls with respect to said windows and for supporting said rolls in a separated condition, locking means carried by one of said chock means of one of said cooperative pairs of chock means, for selectively preventing said pair of rolls from moving axially relative to each other during removal and replacement of said rolls to and from said stand, said means for separating said rolls having an outer end means, plunger means carried by said one chock means arranged to engage said outer end means, and means for allowing said plunger means to be selectively brought into and out of engagement with said outer end means.

9. In a rolling mill stand according to claim 8, means in said upper chock means for preventing said outer end means and said plunger means when in engagement therewith from moving relative to each other axially on said axial movement of said chock means.

10. In a rolling mill stand according to claim 8, including a vertical opening in said upper chock means for receiving said plunger means, said locking means further including an actuator rod having a first end and a second end carried in said upper chock means arranged to have said first end engage said plunger means and said second end engage an actuator means carried by said upper chock means, and wherein said outer end means has a recess for receiving a lower end of said plunger means in a manner to create a locked relationship therewith.

11. In a rolling mill stand according to claim 10, including two axially spaced apart grooves in said actuator rod, locating means carried by said upper chock means arranged to selectively engage one or the other of said grooves, and means for continuously urging said locating means in a direction of said actuator rod.

12. In a rolling mill stand according to claim 10, wherein said actuator rod is formed to have two actuating portions, one axially displaced relative to the other, said portions being arranged to effect a locking and unlocking condition with respect to said outer end means and said plunger means.

13. In a rolling mill stand according to claim 8, wherein each said opposite sides of said lower chock means has roll carrying means, and each said block member has support means arranged to selectively engage said carrying means thereby allowing in said engaged condition said rolls as a unit with their chock means to be removed and replaced to and from said window.

14. In a rolling mill stand according to claim 13, wherein said housing means comprises two spaced apart upright posts each having a said window, each said window having a said cooperative pair of chock means, said block members and said intermediate means, and wherein said support means is arranged to extend between said posts and through said windows below said roll pass for engaging said carrying means of said lower chock means.

15. In a rolling mill stand according to claim 14, wherein said carrying means include wheel means secured to the lower portion of said opposite sides of said lower chock means, said wheel means and said support means being arranged in a juxtapose relationship when said wheel means is engaged by said support means, and means for causing said support means to engage said wheel means.

16. In a rolling mill stand according to claim 15, wherein said support means comprises a pair of rail means arranged adjacent said opposite sides of said lower chock means, and a piston cylinder assembly carried by each said block member connected to said rail means.

17. In a rolling mill stand according to claim 8, wherein one of said post is a drive side post, said locking means being carried by said upper chock means of said cooperative pairs of chocks at said drive side post, said means for separating said rolls being mounted in said lower chock means, said outer end means comprising a centering means carried by said means for separating said rolls, said plunger means carried by said upper chock means, in which said plunger means and said centering means are arranged to engage each other when locking is to be effected.

* * * * *